United States Patent [19]

Maruyama et al.

[11] B 3,999,242

[45] Dec. 28, 1976

[54] CLEANING APPARATUS

[75] Inventors: Masahiko Maruyama; Shosuke Oka, both of Nagoya, Japan

[73] Assignee: Mitsubishi Denki Kabushiki Kaisha, Tokyo, Japan

[22] Filed: Feb. 27, 1975

[21] Appl. No.: 553,629

[44] Published under the second Trial Voluntary Protest Program on February 24, 1976 as document No. B 553,629.

[30] Foreign Application Priority Data

Feb. 27, 1974 Japan ..... 49-23572

[52] U.S. Cl. ..... 15/302; 15/50 R; 15/103; 15/418

[51] Int. Cl.[2] ..... A47L 1/02

[58] Field of Search ..... 15/50 R, 103, 302, 320, 15/368, 373, 418

[56] References Cited

UNITED STATES PATENTS 3,497,902 3/1970 Hartigan ..... 15/302

3,715,774 2/1973 Fannon ..... 15/302

3,775,804 12/1973 Hoener ..... 15/302

*Primary Examiner*—Billy J. Wilhite

*Assistant Examiner*—C. K. Moore

*Attorney, Agent, or Firm*—Oblon, Fisher, Spivak, McClelland & Maier

[57] ABSTRACT

An apparatus for cleaning windows and the like characterized by a housing containing a nozzle for injecting a cleaning solution and a brush being movable under contacting relation with the surface to be cleaned, wherein the end of the housing facing the surface to be cleaned is open to form an aperture and the aperture is closeable by a movable edge of the housing. A wiper is disposed on the movable edge of the housing, being operated through an interlocking mechanism for moving the brush toward and away from the surface to be cleaned, whereby in the case of withdrawing the brush, the aperture of the housing is automatically closed so that the wiper may be fully utilized.

10 Claims, 5 Drawing Figures

CLEANING APPARATUS

BACKGROUND OF THE INVENTION

1. Field of the Invention:

The present invention relates generally to a cleaning apparatus which is suitable for cleaning window glass, walls and floors, and more particularly to an automatic cleaning apparatus for cleaning the surface under moving conditions.

2. The Prior Art

The cleaning of the windows of a tall building has heretofore been accomplished by the hand operation of an operator while riding on a scaffold which is vertically movably suspended from the top of the building. This method is obviously quite dangerous in the case of very high buildings and the efficiency of the cleaning operation is disadvantageously quite low.

In order to improve upon the disadvantages of this conventional method, automatic cleaning apparatus have previously been proposed, such as that which is disclosed in U.S. Pat. No. 3,604,049 and U.S. Pat. No. 3,298,052. Each of these cleaning apparatus comprises a housing containing a brush and a squeegee and having an aperture at one end of the housing facing toward the surface to be cleaned. While such apparatus have generally performed in a successful manner, they have not proven to be entirely satisfactory.

SUMMARY OF THE INVENTION

Accordingly, it is an object of the present invention to provide an improved cleaning apparatus for cleaning windows and the like.

Another object of the present invention is to provide an improved apparatus for efficiently and automatically cleaning windows and the like.

The foregoing and other objects are attained according to the present invention through the provision of a housing containing a nozzle and having a brush being movable while contacting the surface to be cleaned through an aperture provided in one end of the housing facing toward the surface to be cleaned one edge of the housing being movable for closing the aperture thereof. A wiper is disposed at one end of the housing, being fixed thereto, which is actuated through an interlocking mechanism for moving the brush toward the surface to be cleaned, and the wiper thus is contacted with the surface to be cleaned simply by drawing or pulling the brush inward to close the aperture of the housing, whereby the cleaning operation of the wiper may then cover from the upper edge to the lower edge of a window. In accordance with the present invention, therefore, a surface may be cleaned while maintaining a gap between such surface and the aperture of the housing and by maintaining a negative pressure in the inner space of the housing and feeding a cleaning solution from a nozzle to the surface being cleaned. Thus the cleaning apparatus of this invention readily cleans a window glass, a wall, or the like with a wiper, a rotary brush and a cleaning solution without leakage of the cleaning solution of sucking the solution from the surface so as to clean the surface both speedily and safely.

BRIEF DESCRIPTION OF THE DRAWINGS

Various other objects, features and attendant advantages of the present invention will be more fully appreciated as the same becomes better understood from the following detailed description when considered in connection with the accompanying drrawings, wherein like reference numerals designate like or corresponding parts throughout the several views and in which.

DESCRIPTION OF A PREFERRED EMBODIMENT

Figure 1:
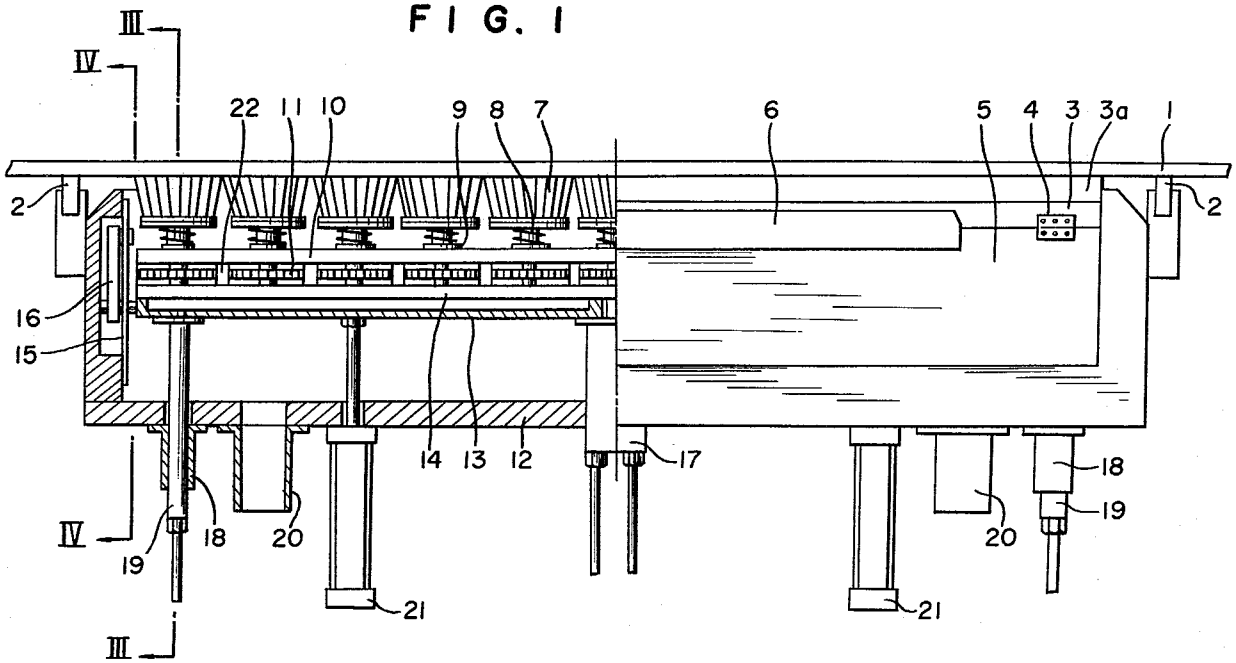
FIG. 1 is a plan view of an embodiment of a cleaning apparatus, constructed according to the present invention.

Referring now to the drawings, a housing 12 is shown being movable along a surface to be cleaned, such as, for example, in this case, a window glass 1 of a building, the housing 12 being of a box-shaped configuration having an aperture or opening in one side thereof. The housing is disposed during operation so that the aperture faces toward the window glass 1, such that a plurality of circular brushes 7, shown being arranged in a horizontal line, which are fitted to shafts 9 disposed in the housing 12, face toward the aperture, and thus toward the surface to be cleaned.

Figure 3:
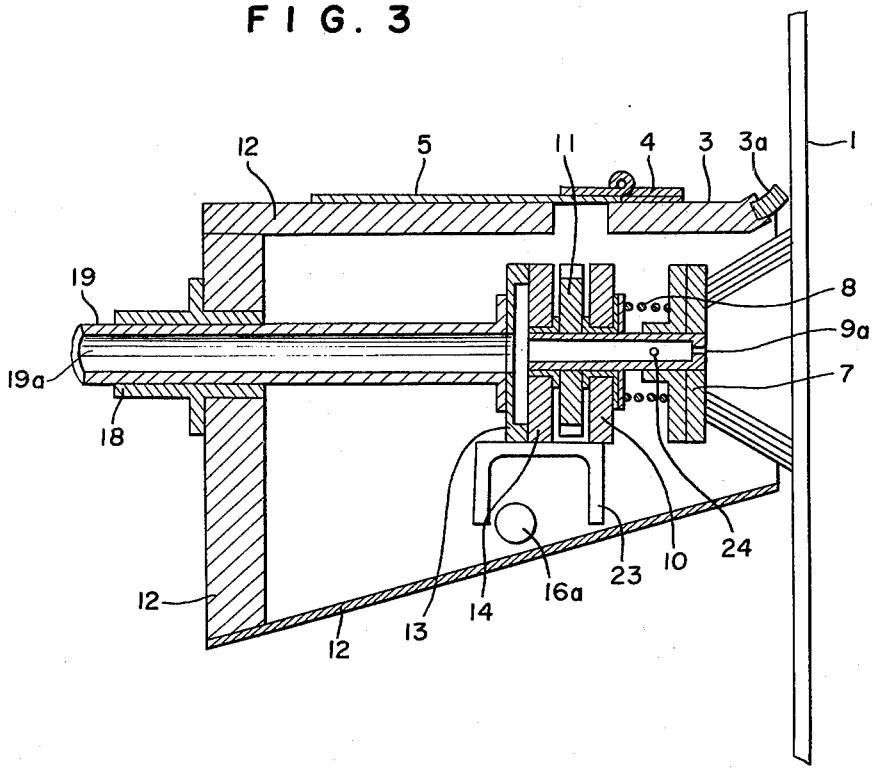
FIG. 3 is a sectional view taken along the line III—III of FIG. 1.

As shown in FIG. 3, a flange is mounted on each shaft 9 carrying a brush 7 and a spring 8 is disposed between the flange and the brush 7, the brush 7 being slidable on the shaft 9 in the axial direction thereof by the spring force of spring 8 so as to be projected toward the window glass 1. A pin 24 is fitted on the shaft 9 and the brush 7 is connected to the shaft 9 with the pin 24 of the shaft 9 being disposed in a longitudinal groove of the brush collar. The brush 7 is thus axially slidable on the shaft 9 in the range of the longitudinal groove and the rotational force of the shaft 9 is transmitted to the brush 7 by the pin 24. The shaft 9 also has a longitudinal bore for passing a cleaning solution therethrough which terminates in a nozzle **9*a* at the end thereof being adjacent the window glass 1, as shown in FIG. 3**.

A gear 11 is mounted on the rear end of the shaft 9 and the shaft 9 is rotatable to a gear case 10 and a gear case 14 through an interlocking relation provided around the gear 11, as shown in FIGS. 1 and 3. As shown in FIG. 1, the gears 11 disposed between the gear case 10 and the gear case 14 are respectively interlocked to each of the adjacent gears 11 so as to provide for rotation of all of them simultaneously. The gear case 10 and the gear case 14 are fixed to each other by the pins 22.

As shown in FIGS. 1 and 3, a water passage plate 13 is mounted on the rear end of the gear case 14 in closed contact therewith. A cleaning solution is fed from a slide bar 19 fixed to the water passage plate 13 to fill a chamber provided by a recess in the water passage plate 13 and closed by the gear case 14, and is then fed through the central bore of the shaft 9 to the nozzle **9*a*. The slide bar 19 fixed to the water passage plate 13 is supported within a bearing 18 disposed in a rear wall of the housing 12, so as to be slidable in the bearing 18 in a direction toward and away from the surface to be cleaned, as shown in FIGS. 1 and 3. The slide bar 19 carries the brush 7, the shaft 9, the gear case 10, the gear 11, the gear case 14, and the water passage plate 13**.

As shown in FIG. 1, a suction inlet 20 is formed in the rear wall of housing 12. An air cylinder 21 also is fixed to the rear wall of housing 12 and a rod thereof is fixed on the rear end of the water passage plate 13 through the housing 12. An air motor 17 is fixed to the water passage plate 13 at the center thereof and the output shaft of the air motor 17 is connected to the central one of the shafts 9 by a spline connection. The central shaft of the shafts 9 has no bore for passing the cleaning solution, nor a nozzle 9*a*, such as do the remaining shafts 9. An internal gear spline, not shown, for interlocking to an external gear spline, not shown, of air motor 17 is disposed on the shaft. The central one of the shafts 9 thus transfers revolution force from the air motor 17 to the adjacent shafts through the gears 11 thereof, in a series fashion.

On an upper edge of the housing 12, a moveable wiper arm 3 is disposed extending along the longitudinal length of the front edge of the housing, or in a horizontal line relative to the surface to be cleaned, as shown in FIGS. 1 and 3. An elastic wiping blade 3*a* is disposed on the wiper arm 3 at the forward end thereof facing toward the surface to be cleaned, being secured in a longitudinal recess thereof. The wiper arm 3 itself is fixed at both ends to arms 15 disposed in the housing 12 at both sides thereof and rotatable relative thereto about the fulcrum 15*a*, as shown best in FIGS. 4 and 5. Accordingly, the wiper 3 may be actuated so as to close the aperture of the housing 12 in the manner described below.

A shutter 5 is secured by a hinge 4 to the upper part of the wiper arm 3, the shutter 5 being rotatable around the hinge 4 to contact with the housing so as to provide a cover for the upper part thereof. The joint between the wiper arm 3 and the shutter 5 is sealed by a covering seal 6, as shown in FIG. 1. A pair of bi-armed links 16 respectively disposed on the inner sides of the ends of the ends of the housing 12 are pivotable about a link fulcrum 16*c* carried by the housing, as shown best in FIGS. 4 and 5. A pin 16*b* fixed adjacent one end of one of the arms of the link 16 is disposed in a longitudinal groove or slot formed in the arm 15 just below the surface thereof carrying the wiper arm 3. A cam follower 16*a* fixed adjacent the end of the other of the arms of the link 16 is disposed between depending cam surfaces of a cam 23, shown in FIG. 3. The cam 23 is fixed to the gear case 10 and the gear case 14.

Figure 2:
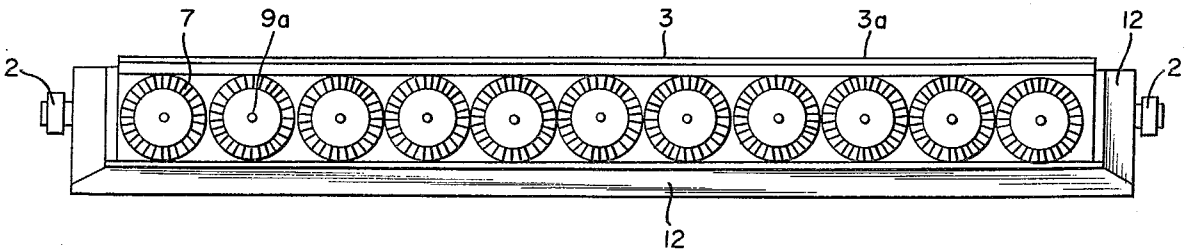
FIG. 2 is a front view of the cleaning apparatus shown in FIG. 1.
Figure 4:
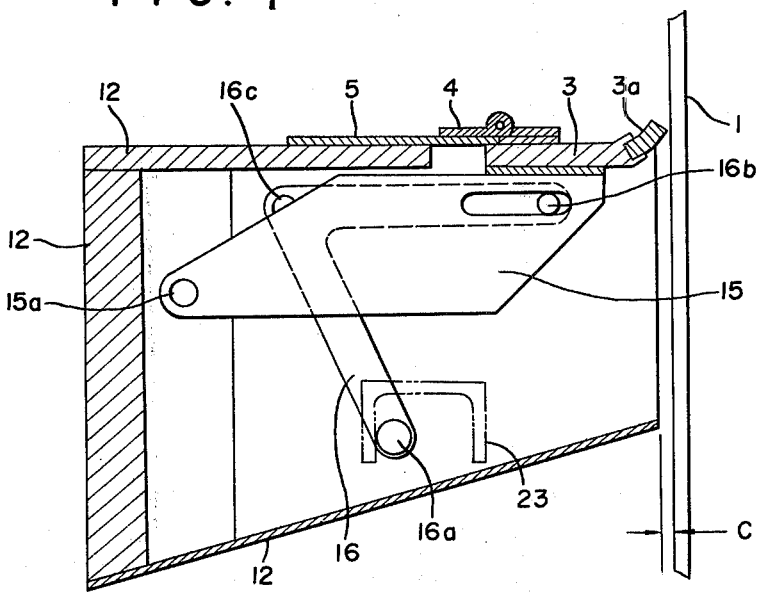
FIG. 4 is a sectional view taken along the line IV—IV of FIG. 1.

As shown in FIGS. 1 and 2, rollers 2 rotatably carried by the housing 12 at both outside ends thereof project outwardly, or forwardly, from the aperture of the housing 12 a distance corresponding to the gap *c*, shown in FIG. 4, and are rotated under contacting relation with the window glass, or surface 1 to be cleaned, when the apparatus is moved along the surface thereof.

The method of operation or manner of use of the apparatus of the present invention will now be described. The cleaning apparatus is moved toward the window glass 1 so as to dispose the aperture of the housing 12 in parallel relation to the window glass 1 and to dispose the longitudinal extent of the front edge of the housing 12 parallel to the horizontal direction of the window glass, with the wiper arm 3 being on the upper side thereof. When the rollers 2 are thus contacted with the window glass 1, the wiping blade 3*a* of the wiper 3 is bent under pressing against the surface of the window glass 1, and the aperture of the housing 12 is substantially parallel to the window glass 1. The distance between the housing 12 and the window glass 1 is maintained equal to the gap *c*, which preferably is about 1.5 mm, because the rollers 2 project forwardly of the housing by that amount.

At this time, the brushes 7 are projected from the aperture of the housing 12, below the wiper 3, and are pressed against the window glass 1, as shown in FIG. 3, to impart pressure between the window glass 1 and the brushes 7, thus compressing the spring 8, by extending the rod of the air cylinder 21. Operation of the air motor 17 causes rotation of the central one of the shafts, such rotation being transmitted through the gears 11 so as to rotate all of the brushes 7 while they are being pressed against the window glass 1. The cleaning solution is fed through the central bores of the slide bars 19 at the time of starting the air motor 17, thereby filling the chamber between the water passage plate 13 and the gear case 14 with cleaning fluid, from where it is injected through the central holes of the shafts 9 and from the nozzles 9*a* against the window glass 1. At the same time, the air in the housing 12 is sucked by the blower, not shown, from the suction inlet 20, to provide a negative pressure in the housing 12, and accordingly air is pulled through the gap *c* between the window glass 1 and the housing 12 so as to cause a constant air flow at the gap *c*. The air flow is effective for recovering the cleaning solution injected against the window glass 1 and removing the same out through the suction inlet 20. Accordingly, the cleaning solution is not leaked from the gap *c*. The air flow through the gap *c* into the housing is a turbulent flow having a Reynold's number of 9,000 or 10,000. Higher negative pressure in the housing 12 is preferable for preventing leakage of the cleaning solution through the cap *c* and for removing the cleaning solution through the suction inlet 20. In a preferred embodiment, the negative pressure is −200 mm Hg.

When the apparatus is moved downwardly along the window glass 1, the window glass 1 is washed by the friction of the brushes 7 and the cleaning solution. The cleaning solution is removed by the wiper blade 3*a* and such cleaning solution containing dust is taken away through the suction inlet 20 by the air flow being fed from the periphery of the apparatus, through the gap *c* of the housing 12, that is between the housing 12 and the window glass 1, so as to effectively and efficiently clean the window glass.

Figure 5:
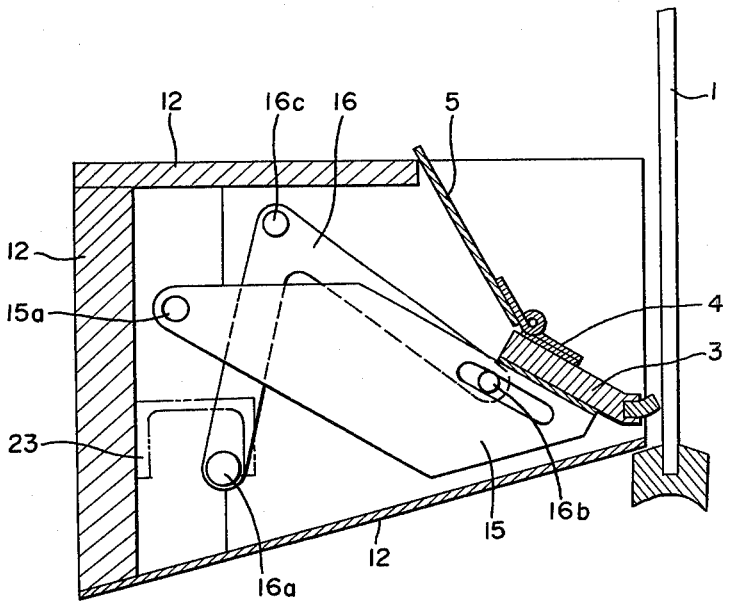
FIG. 5 is a sectional view taken along the same line as shown in FIG. 4, but illustrating the apparatus in a closed condition.

When the apparatus reaches the lower end of the window 1, that is, the lower window frame, the air cylinder 21 is driven to pull in the cylinder rod thereof. By operation of the air cylinder 21, the water passage plate 13, the gear case 10, the gear case 14, the gear 11, the shaft 9 and the brushes 7, are pulled by the cylinder 21 into the housing 12 and behind the aperture. At this time, the slide bars 19 are slidably moved within the bearings 18. By movement of the parts, arranged as described, the cams 23 fixed to the gear case 10 and the gear case 14 are moved rearwardly and the cam followers 16*a* interlocked to the cams 23 are moved. By such movement, the links 16 are rotated around the fulcrums 16*c* and the cam followers 16*b* connected to the links 16 downwardly rotate the cam 15 in a clockwise direction, as seen in FIGS. 4 and 5. In FIG. 4, the condition of the arm 15 before rotation of the link is shown, and in FIG. 5, the condition after such rotation is illustrated. The wiper arm 3 fixed to the upper surface of arms 15 is moved downwardly with the arms 15, under contacting relation of the wiper blade 3*a* with the window glass 1, and the aperture of the housing 12 is thus closed by the shutter 5 and the wiper 3, as shown in FIG. 5. Accordingly, the wiper 3 can approach the lower end of the window frame of the window glass. The range of movement of the wiper 3 for cleaning is therefore from the upper end to the lower end of the window frame.

The shutter 5 serves to shield the surface closed by the shutter to prevent air flow through this area so as to maintain the desired negative pressure in the housing 12. The gap between the cams 23 and the cam followers 16*a* are provided for preventing interference of the brushes 7 caused by the operation of the wiper 3 given by rotating the arms 15, whereby the wiper 3 is downwardly moved after moving the brushes 7.

After completing the cleaning operation, the apparatus is of course separated manually from the window glass.

Obviously, many modifications and variations of the present invention are possible in light of these teachings. For example, while two rollers 2 are used as contactors for providing the gap *c* between the housing 12 and the window glass 1 in the illustrated embodiment, the contactors also can be ones which are not rotatable and the number of the contactors can be two or more. Also, while the rollers 2 are shown as being directly contacted against the window glass 1, it is possible that another place may be contacted instead, so long as the gap *c* can be maintained. It is also possible to maintain the gap *c* by detecting the gap *c* with a sensor and controlling a driving device for approaching the apparatus to the window glass 1.

In addition, while brushes 7 are rotatable about an axis perpendicular to the surface of the window glass 1 in the disclosed embodiment, any other type of friction could be imparted on the window glass, such as, for example, a vibratory motion could be imparted against the window glass 1. Further, though the wiper 3 is shown being driven by a link 16 for closing the aperture of the housing 12, it is possible, however, to provide an operation to close the aperture by lifting up the lower edge of the housing 12 toward the upper side.

Still further, a cleaning operation for window glass has been illustrated. However, it is possible also to clean a wall or a floor of a building.

In accordance with another contemplated embodiment of the invention, wipers disposed in the upper part of the aperture of the housing and the lower edge of the housing could approach each other so as to close the aperture of the housing, whereby all the surface covered by the aperture of the housing 12 can be cleaned by the wiper. For example, in the case of the cleaning operation of a window glass, the wiper in this case can approach the lower end of the window frame of the window glass.

Accordingly, it is to be understood that within the scope of the appended claims, the invention may be practiced otherwise than as specifically described herein.

What is claimed as new and desired to be secured by letters patent of the United States is:

1. A cleaning apparatus comprising:

a housing having an opening in a forward end thereof, brush means movably disposed in said housing between a first retracted position within said housing and a second projecting position wherein said brush means projects from said opening;

nozzle means for feeding a cleaning solution from within said housing through said opening to be applied against a surface to be cleaned;

means for moving said brush means in said second projecting position thereof under contacting relation with said surface to be cleaned for cleaning said surface;

a movable member supported on said forward end of said housing for closing said opening therein when said brush means is disposed in said first retracted position; and wiper means carried by said movable member for contacting said surface to be cleaned.

2. The cleaning apparatus set forth in claim 1, further comprising:

means for moving said brush means selectively between said first retracted position and said second projecting position; and an interlocking mechanism connecting said means for moving said brush means between said retracted and said projecting positions thereof and said movable member, whereby said movable member closes said opening upon said brush means being moved to said first retracted position and opens said opening upon said brush means being moved to said second projecting position.

3. The cleaning apparatus as set forth in claim 2, wherein said movable member comprises a shutter and a wiper carrying member hingedly connected to each other.

4. The cleaning apparatus set forth in claim 2, wherein said interlocking mechanism comprises a cam connected to said means for moving said brush means between said retracted and projecting positions, a link interlocked with said cam; and an arm interlocked with said link and carrying said movable member.

5. The cleaning apparatus set forth in claim 4 wherein said cam includes a delay mechanism for actuating said arm after moving said brush means.

6. The cleaning apparatus set forth in claim 2, wherein said brush means is a plurality of brushes arranged in a line being simultaneously rotatable by said means for moving said brush means under contacting relation with said surface to be cleaned; and said nozzle means is a plurality of nozzles passing through said brushes.

7. The cleaning apparatus set forth in claim 6, wherein said means for simultaneously rotating said plurality of brushes comprises a single motor for rotating one of said brushes and intermeshing gears for each of the respective other ones of said plurality of brushes.

8. The cleaning apparatus set forth in claim 7, further comprising means for maintaining negative pressure in said housing during operation of the apparatus for withdrawing used cleaning solution through a rear wall of said housing.

9. The cleaning apparatus set forth in claim 1 which further comprises means for maintaining a constant gap between the surface to be cleaned and said opening of said housing.

10. The cleaning apparatus set forth in claim 1, which further comprises means for maintaining negative pressure within said housing during operation of the apparatus.

* * * * *